US007735172B2

(12) United States Patent
Newton et al.

(10) Patent No.: US 7,735,172 B2
(45) Date of Patent: Jun. 15, 2010

(54) MULTI-PURPOSE FIREFIGHTING TOOL

(75) Inventors: Daniel Newton, Richmond, VA (US); Anna Capetanakis, Arlington, VA (US); Markus Andreas Weisner, Charlottesville, VA (US)

(73) Assignee: Fire Hardware, LLC, Charlottesville, VA (US)

( * ) Notice: Subject to any disclaimer, the term of this patent is extended or adjusted under 35 U.S.C. 154(b) by 0 days.

(21) Appl. No.: 12/067,688

(22) PCT Filed: Sep. 21, 2006

(86) PCT No.: PCT/US2006/036709

§ 371 (c)(1),
(2), (4) Date: Oct. 15, 2008

(87) PCT Pub. No.: WO2007/038158

PCT Pub. Date: Apr. 5, 2007

(65) Prior Publication Data

US 2009/0094757 A1 Apr. 16, 2009

Related U.S. Application Data

(60) Provisional application No. 60/719,588, filed on Sep. 23, 2005.

(51) Int. Cl.
*B66F 15/00* (2006.01)
*B25D 1/04* (2006.01)
*B26B 23/00* (2006.01)

(52) U.S. Cl. ..... 7/166; 7/145; 7/158

(58) Field of Classification Search ..... 7/166, 7/158, 145, 144, 161, 167, 159
See application file for complete search history.

(56) References Cited

U.S. PATENT DOCUMENTS

| | | | | |
|---|---|---|---|---|
| 3,219,316 | A * | 11/1965 | Fried | 7/158 |
| 3,710,407 | A * | 1/1973 | Reid | 7/166 |
| 3,837,023 | A | 9/1974 | Spencer-Foote | |
| 4,932,622 | A * | 6/1990 | Hayakawa | 248/188.5 |
| 5,211,118 | A | 5/1993 | Perkins | |
| 5,642,567 | A * | 7/1997 | Lin | 7/158 |
| 6,289,540 | B1 * | 9/2001 | Emonds | 7/159 |
| 6,397,420 | B1 | 6/2002 | Roxton | |
| 6,923,353 | B2 * | 8/2005 | Texidor | 224/163 |
| 7,088,222 | B1 * | 8/2006 | Dueker et al. | 340/321 |
| 2002/0134971 | A1 * | 9/2002 | Christensen | 254/25 |

* cited by examiner

*Primary Examiner*—Hadi Shakeri
(74) *Attorney, Agent, or Firm*—Kenyon & Kenyon LLP

(57) ABSTRACT

The present invention generally relates to firefighting tools, including multi-purpose firefighting tools that may incorporate the capabilities of axes, Halligan bars, K-tools, spike poles, flashlights, etc. The multi-purpose tool may include a removably securable inner shaft and an outer shaft configured to slidably receive the inner shaft. The tool may also include a housing and a locking mechanism. The inner and outer shafts may include various implements. The housing may be disposed on one of the ends of the outer shaft and may include a recess.

18 Claims, 7 Drawing Sheets

MULTI-PURPOSE FIREFIGHTING TOOL

CROSS-REFERENCE TO RELATED APPLICATIONS

This is a 371 national phase application of International Application No. PCT/US06/36709 filed Sep. 21, 2006, claiming priority to U.S. Provisional Application No. 60/719,588 filed Sep. 23, 2005, the contents of which are incorporated herein by reference.

TECHNICAL FIELD

The present invention generally relates to firefighting tools, including multi-purpose firefighting tools that may incorporate the capabilities of axes, Halligan bars, K-tools, pike poles, flashlights, etc.

BACKGROUND

Many firefighting tools are task specific and are not designed to meet the variety of needs firefighters may have inside a burning building or at the scene of an emergency. As a result, fire departments often select several firefighting tools and gather them into a multi-purpose tool set. Often, these sets are awkward to carry, heavy, and generally fall short of providing firefighters with the comprehensive equipment capabilities they need. Firefighters often realize they need a different tool or piece of equipment once already inside a burning building. Firefighting crews then have to either return to their fire engine for more equipment or have another team of firefighters bring in additional tools.

Currently, many fire departments are choosing to use a tool set called "the irons." The set of irons includes an axe, a prying tool known as the Halligan bar, and a lock removal device called the K-Tool. These tools are typically made of steel, collectively weigh about 30 pounds, and are bound together using either a standard belt, Velcro strap, or band of rubber.

Although quite popular in the fire service, the irons have drawbacks. For example, separation of the tools is necessary prior to use. With gloved hands and smoke, firefighters often lack the necessary visibility or dexterity to quickly undo the binding strap. This can result in time delays and/or cause firefighters to temporarily remove a glove to undo the binding, thus, putting an exposed hand at risk for burns and/or other injuries. Moreover, once separated, individual tools in the set or the binding strap itself may be easily lost in the dark. In addition, before the set can be moved to another location, the tools need to be strapped back together again. Another drawback is that the set is heavy. The weight of the set may therefore strain firefighters already wearing a heavy suit and carrying an oxygen tank on their back. These problems, among others, may cause firefighters to lose valuable time at the scene of an emergency.

BRIEF DESCRIPTION

The present invention is directed to tools, including multi-purpose firefighting tools that may incorporate the capabilities of axes, Halligan bars, K-tools, pike poles, flashlights, etc. In accordance with one embodiment of the present invention, a multi-purpose tool is provided. This multi-purpose tool may include a inner shaft which can be removably secured to an outer shaft configured to slidably receive the inner shaft. The inner and outer shafts may include various implements. A housing may be disposed on one of the ends of the outer shaft.

In accordance with another embodiment of the present invention, a multi-purpose tool is provided. This multi-purpose tool may include an inner shaft, an outer shaft configured to slidably receive the inner shaft, and a locking mechanism. The inner and outer shafts may include a pry fork, spike tip, and adz head, respectively. A housing may be disposed on one of the ends of the outer shaft and may include a recess.

In yet another embodiment of the present invention, a multi-purpose tool is provided. This multi-purpose tool may include an inner shaft, an outer shaft configured to slidably receive the inner shaft, a housing, a locking mechanism, and a light. The inner and outer shafts may include a pry fork, a pivotable spike tip, and adz head, respectively. The housing may be disposed on one of the ends of the outer shaft and may include a recess. The locking mechanism and light may be mounted on the housing.

BRIEF DESCRIPTION OF THE DRAWINGS

Referring to the drawings, which form a part of this disclosure.

DETAILED DESCRIPTION

Figure 1:
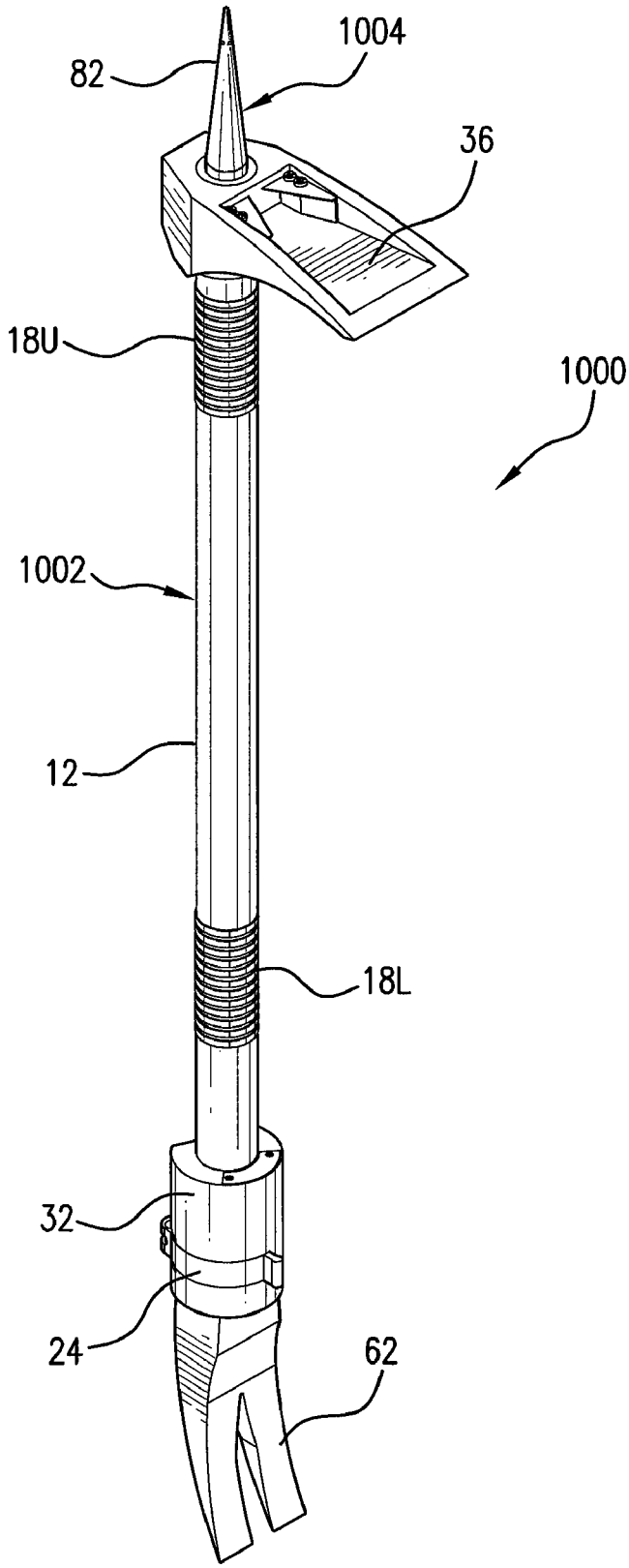
FIG. 1 illustrates a multi-purpose firefighting tool that may be employed in accordance with an embodiment of the present invention.

Embodiments of the present invention generally relate to a multi-purpose firefighting tool that incorporates capabilities of an axe, Halligan bar, K-tool, short pike pole, cellar nozzle, puncturing nozzle, flashlight, and Personal Alert Safety System (PASS) device into one versatile, easy-to-use tool.

Embodiments of the present invention may include, but are not limited to, a multi-purpose firefighting tool comprising a main shaft with adz head, a light, and a removable inner shaft that can be secured within the main shaft. The tool may be configured to meet a user's specific need by selecting an appropriate inner shaft. For example, an inner-shaft may include a Halligan-type tool, a cutting edge, or a global positioning system (GPS) device. The multi-purpose firefighting tool may be used as both as a single unit with a removable inner shaft secured, and/or as separate tools by removing the inner shaft. A retractable strap and/or ergonomic handgrips may also be included to allow for easy carrying and correct hand-positioning.

The multi-purpose firefighting tool may be suitable for purposes other than firefighting. For example, embodiments of the device may also be suitable for organizations such as rescue squads and emergency medical services, the Unites States Forest Service, the United States Military, civil defense groups, national security agencies, CIA, FBI, and police and SWAT teams. Any part of the tool may be configured for addressing the specific needs of a user. For example, in military applications, the removable inner shaft component may have special cutting components, firing components, ammunition carrying components, electronic position tracking components, and/or medical monitoring components.

Also, in accordance with embodiments of the present invention, while some users may choose to use fixed configurations of the present invention, teams (e.g., SWAT) may carry a full line of different removable components in their response vehicles. Possible components may include tear gas launchers, battering rams, electronic recording devices, or high-powered directional lights. Consequently, while in route to an emergency or during an on-scene mission briefing, an equipment technician might complete on-the-spot reconfigurations of embodiments of the present invention to address the team's needs.

Still further, in accordance with embodiments of the present invention, some teams may want to integrate a particular weapon, tool, or device into the outer shaft of embodiments of the present invention. It is contemplated that the outer shaft may be modified to achieve this, for example, such as by mounting a cutting edge or gun along the longitudinal-axis of the outer shaft handle or integrating electronic devices such as a video camera into the light housing.

The present invention may also have an integrated locater beacon similar to those used by the United States Coast Guard or backcountry skiers. This locator beacon may be used to find distressed personnel or simply keep track of teams at the scene of an emergency.

FIG. 1 illustrates a multi-purpose firefighting tool 1000 in accordance with one embodiment of the present invention. The multi-purpose firefighting tool 1000 in this embodiment comprises an outer shaft 1002 and an inner shaft 1004. The multi-purpose tool may be constructed of any suitable size, shape and material. For example, the tool may be approximately the same size as a standard firefighting axe (e.g., handle length of about 36 to 48 inches). The dimensions of the present invention may also be changed to accommodate people of different heights and weights.

The multi-purpose firefighting tool 1000 may also include a personal escape rope attachment point (not shown). For example, in some instances, firefighters may hammer the invention into the floor of a burning building, attach a rope, and repel out of a window. Therefore, embodiments of the present invention may include loops, hooks, or other devices for firefighters to secure a rope to and take a similar course of action.

Figure 2:
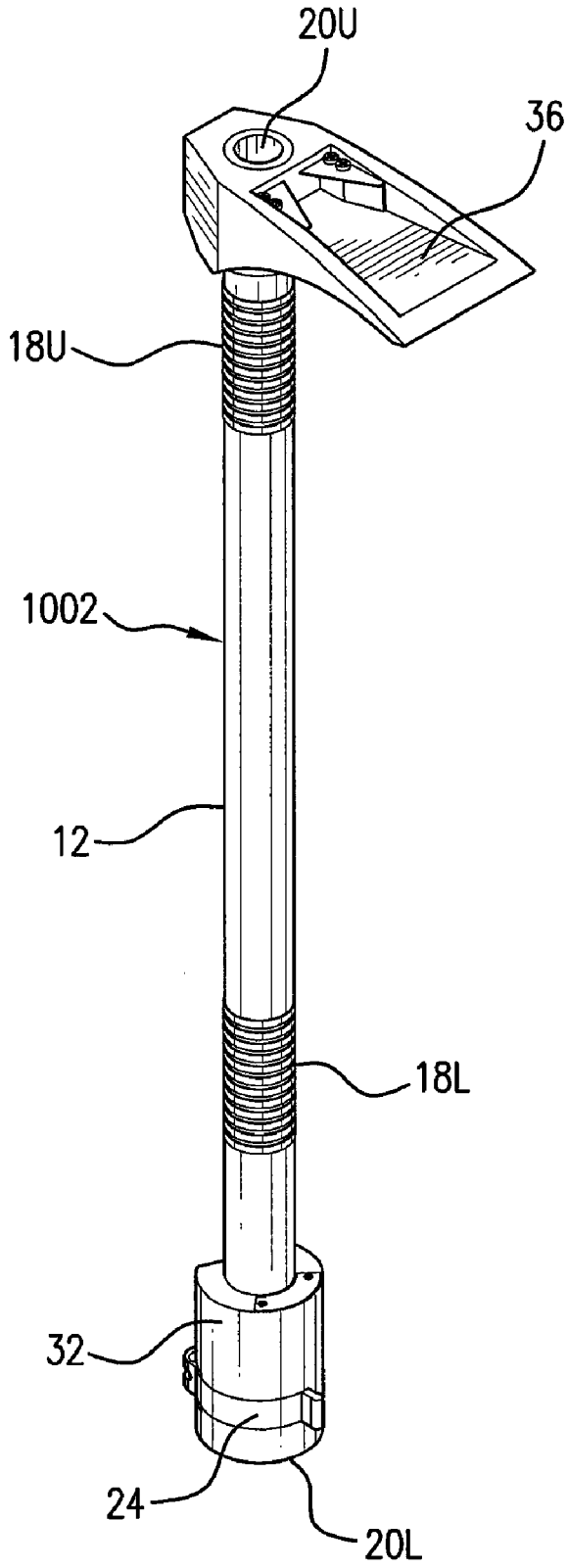
FIG. 2 illustrates an outer shaft of the tool of FIG. 1.

Embodiments of the outer shaft 1002 are illustrated in FIGS. 1-2. The outer shaft 1002 comprises a outer shaft handle 12, a lower outer shaft handgrip 18L, an upper outer shaft handgrip 18U, an adz head 36, and a light housing 32 including a friction lock system 24. In this embodiment, the inner shaft 1004 includes a spike tip 82. The outer shaft handle 12 extends the length of the outer shaft 1002 and may have round, oval, or ergonomically shaped cross-sections disposed perpendicularly to the longitudinal-axis of the outer shaft handle 12. The outer shaft handle 12 is straight in the illustrated embodiment, but may also have a slight bend for improved performance in alternate embodiments. The lower outer shaft handgrip 18L and upper outer shaft handgrip 18U wrap around the outer shaft handle 12 and are intended to help firefighters correctly grip the multi-purpose firefighting tool 1000.

Suitable materials for the outer shaft handgrips 18U, 18L may include fire-resistant rubber, cloth, textured metal, or a similar material.

As seen in FIG. 2, a hollow interior section along the longitudinal-axis of the outer shaft handle 12 may open at both ends of the outer shaft handle 12 to expose shaft bays 20U, 20L for securing the removable inner shaft 1004. These shaft bays 20U, 20L may be shaped so as to secure a multitude of removable components.

Also as seen in FIG. 2, the removable inner shaft 1004 may be secured in the outer shaft 1002 using a locking device, for example, a friction lock system 24. In the embodiment illustrated, the light housing 32 and the friction lock system 24 may be integrated.

Figure 5:
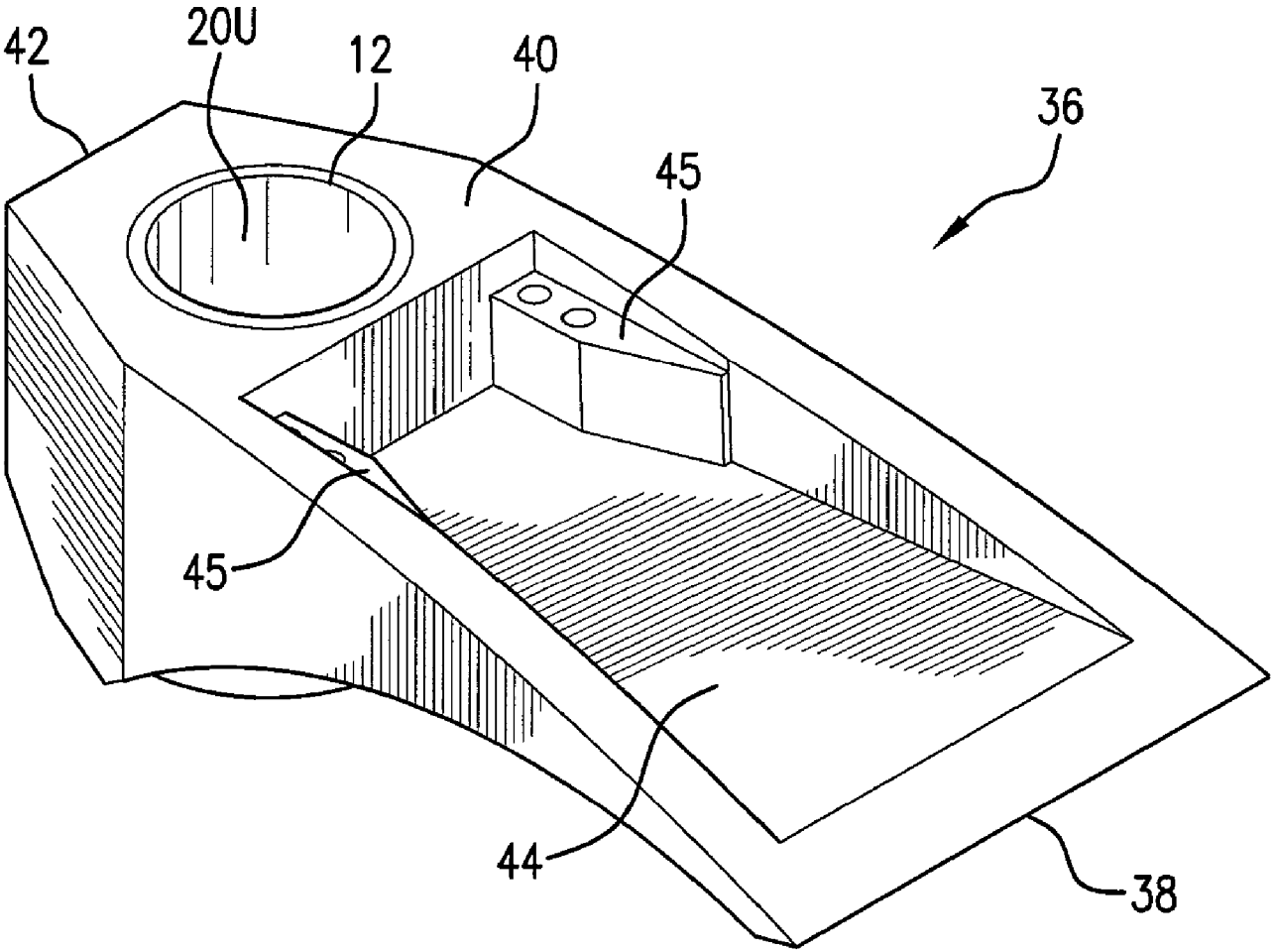
FIG. 5 shows a perspective view of an adz head that may be employed in accordance with an embodiment of the present invention.

As seen in FIGS. 1, 2, and 5, the outer shaft 1002 may have an adz head 36 mounted near the top of the outer shaft 12. In FIG. 5, it may be seen that the outer shaft handle 12 extends through the adz head 36 to the adz head top 40. The adz head cutting edge 38 may be oriented perpendicular to the longitudinal-axis of the outer shaft handle 12, but can also have a parallel or user-adjusted orientation. The adz head back 42 may form a slightly textured hammering surface and the adz head top 40 may have an adz head cut-out 44 large enough to fit a cylindrical door lock. A narrowing channel incorporated into the adz head cut-out 44 can have two sharp lock removing blades 45 for prying off door locks.

Embodiments of the adz head 36 may also have differently configured adz head cut-outs 44 or provide an attachment point for attaching additional tools. The adz head 36 may be orientated differently (e.g., possibly an axe-like orientation or user-adjusted orientation) or located elsewhere on the multiple-purpose firefighting tool 1000. The adz head 36 may also have a different shape or look so that users will recognize it as either a cutting or prying tool. Embodiments of the present invention may also not include an adz head 36.

Figure 4A:
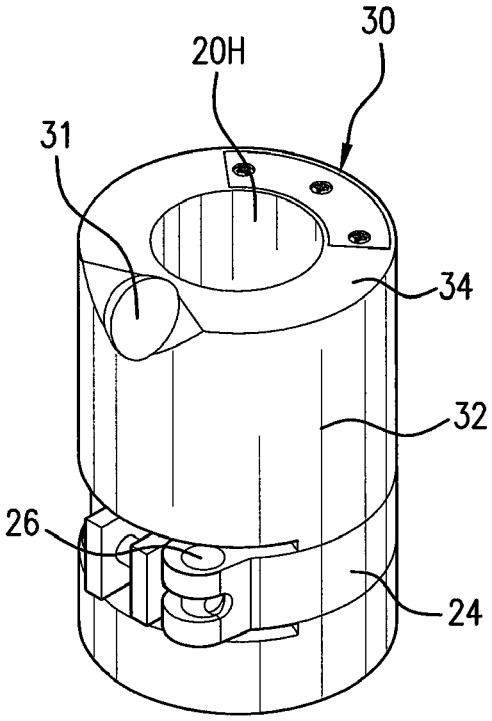
FIGS. 4A, 4B, and 4C show a light housing that may be employed in accordance with an embodiment of the present invention.
Figure 4B:
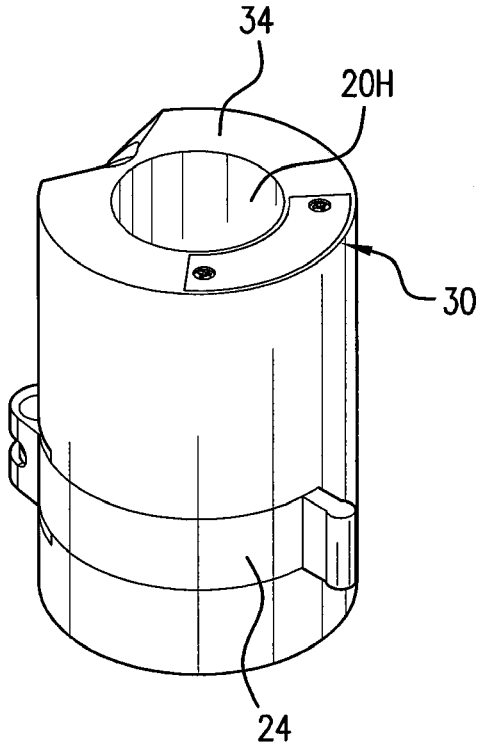
Figure 4C:
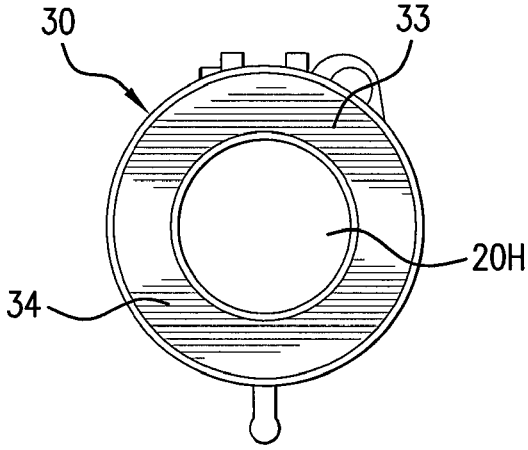

Turning to FIGS. 4A-C, the light housing 32 may be configured for mounting to the outer shaft 12 and receiving inner shaft 1004 in any suitable manner via recess 20H (which is communication with shaft bay 20L), including, but not limited to, by adhesives, friction, fasteners, etc. The light housing 32 may comprise a light 30, a light switch 31, and a friction locking system 24 with a cam lever or friction axle 26. The light housing 32 cross-section of FIGS. 4A-C is substantially round, however, any suitable shapes may be used. A light-emitting diode ring 34 is also shown. The light-emitting diode ring 34 includes diodes 33 and may be oriented to shine light away from the outer shaft 1002 along the longitudinal-axis of the outer shaft handle 12, but may also be configured to shine in multiple directions or illuminate component-specific target areas. The light 30 may also be mounted in different locations on the outer shaft 1002, possibly inside the shaft bays 20U, 20L or as part the lower outer shaft handgrip 18L. Alternate embodiments of the present invention may have a removable light secured within the shaft bays 20U, 20L. Any suitable light source may be used including, but not limited to, lasers, chemicals, reflective tape, strobe lights, phosphorescent stickers, phosphorescent paint, and/or light bulbs.

The light 30 may also shine different colors or be user-adjustable. The light 30 can be used to signal other firefighters inside a building or pointed at a window to signal an outside command post. For example, a red light may signal the need for additional help, while a green light may let others know that a fire has been extinguished. Multiple integrated lights may be positioned on the multi-purpose firefighting tool 1000 to illuminate component-specific target areas while firefighters work. The lights may be user-adjustable to accommodate different components. The lights may be located on the main shaft or on the removable components being used. Lights located on removable components may automatically turn on once the component is removed from the main shaft 1002.

Figure 6:
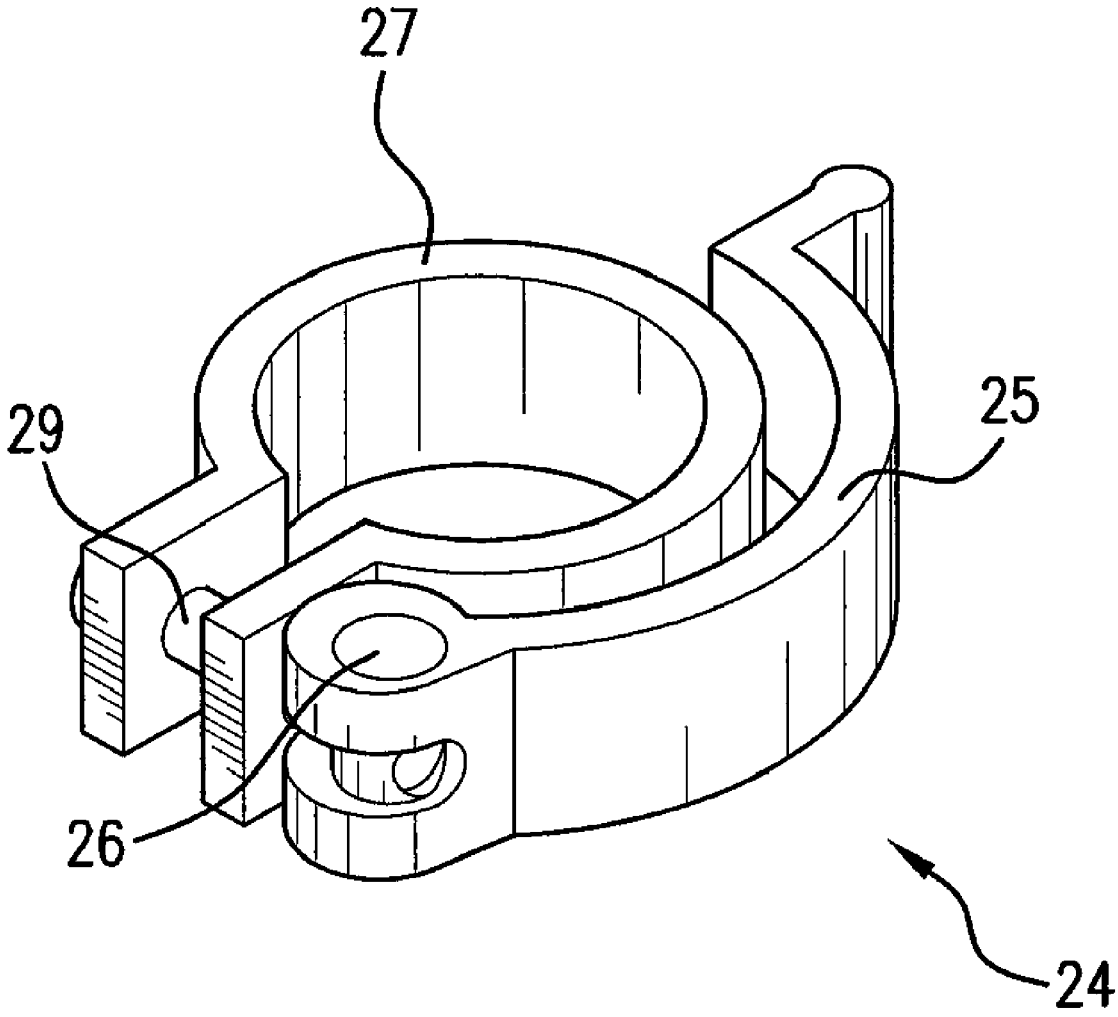
FIG. 6 is a perspective view of a friction lock that may be employed in accordance with the present invention.

As seen in FIG. 6, the friction lock system 24 may comprise a friction ring 27, a friction lever 25, a friction bolt 29, and a friction axle 26. This friction lock system 24 may work much like a bicycle seat post clamp or camera tripod clamps, wherein the friction lever 25 can be used to activate or deactivate friction ring 27. Locking devices may be used on either end of the outer shaft 1002 and multiple locking devices may be used to secure the inner shaft 1004. Alternate embodiments of the present invention may use modified friction locking systems or any other suitable locking device, such as twist locks or push-pin locks to secure the inner shaft 1004.

Figure 3A:
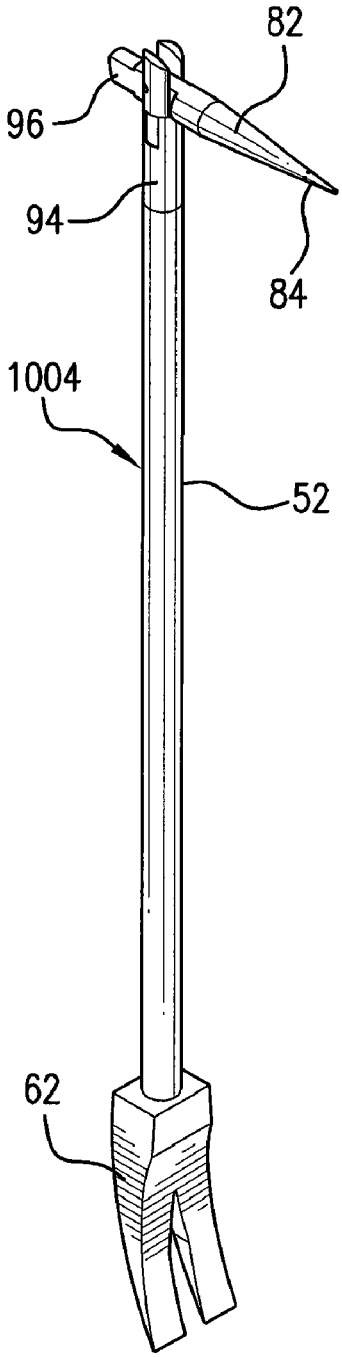
FIGS. 3A and 3B illustrate an inner shaft of the multi-purpose tool of FIG. 1 in hinged and straight positions, respectively.
Figure 3B:
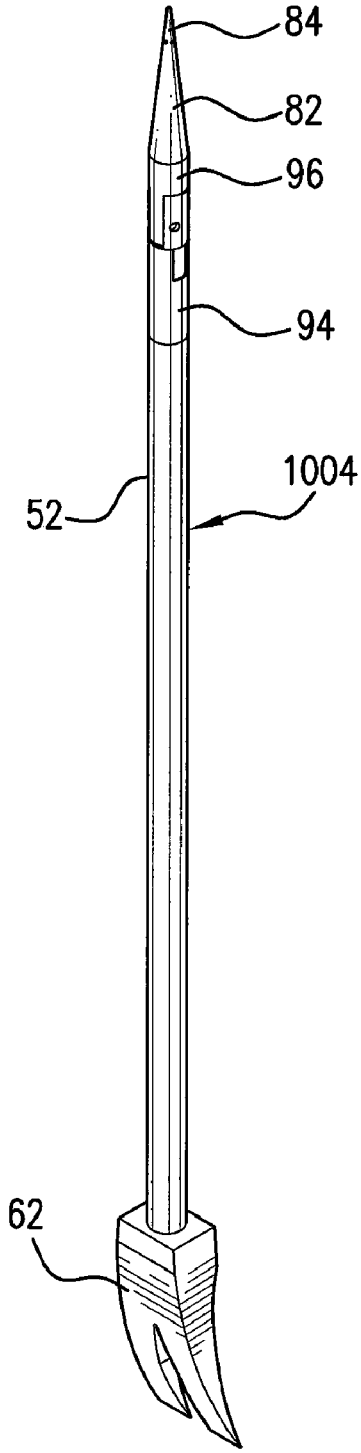
Figure 3C:
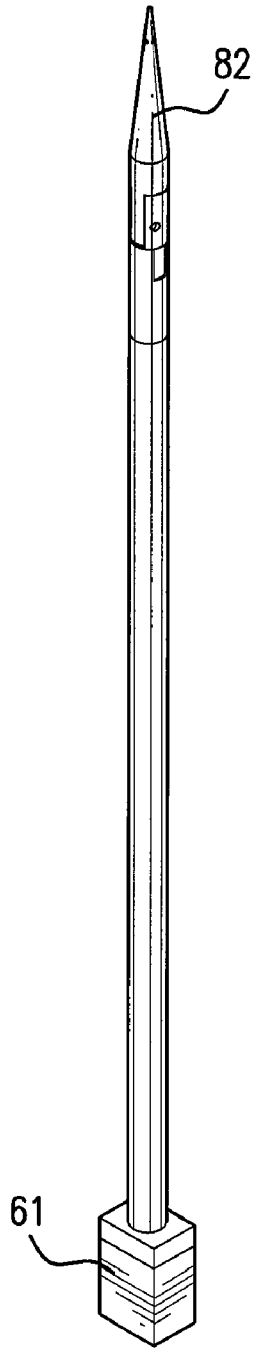
FIG. 3C illustrates an alternative embodiment of the inner shaft of FIG. 1.

The embodiments of FIG. 1 and FIGS. 3A-B show an inner shaft 1004 comprising a spike tip 82 and pry fork 62 for securing or secured in the shaft bays 20U, 20L. As discussed herein, alternate embodiments of the present invention may have removable cutting edges, hammering tools, electronic lights, GPS units, and/or health monitors. As seen in FIGS. 3A-3B, the inner shaft 1004 may also comprise an inner shaft handle 52, and a spike tip nozzle 84. The inner shaft handle 52 may connect the spike tip 82 on one end to a pry fork 62 on the other end. The pry fork 62 may attach to the pry tool handle 52 so that two claw forks point away from the inner shaft 1004 along the longitudinal-axis of the inner shaft handle 52. Alternative embodiments of the pry fork 62 may have a cutting claw or a tip. In addition, the inner shaft may comprise any suitable tool, for example, FIG. 3C shows a spike tip 82 and a locator beacon 61.

Instead of an inner shaft 1004 that can only be removed from one end of the outer shaft 1002, the embodiments of the present invention may have an inner shaft that can be removed from either side of the outer shaft 1002. It may also be desirable to have two separate inner shafts each being removable from their respective side of the outer shaft 1002.

The inner shaft may also have a locking hinged joint comprising a spike lock sleeve 94, spike lock sleeve spring (not shown), and a spike pin 96 incorporated into the inner shaft handle 52. The locking hinged joint may work in a similar fashion to a locking carabineers used for rock climbing.

To secure the inner shaft 1004 in the shaft bays 20U, 20L of the outer shaft 1002, the user may insert the inner shaft 1004 into the shaft bays 20U, 20L and use the friction lever 25 to activate the friction lock 24. To remove the inner shaft 1004, a user may use the cam lever or friction lever 25 to deactivate the cam lock or friction lock 24 and pull on the pry fork 62.

Figure 7:
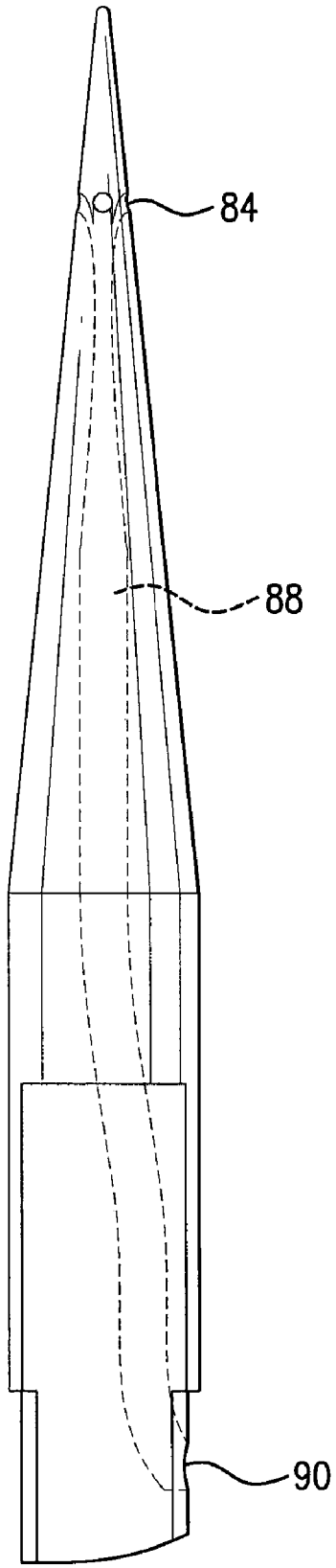
FIG. 7 shows a side view of a puncture nozzle spike in accord with the present invention.

The inner shaft 1004 may have integrated nozzles for streaming fluid into hard-to-reach spaces. For example, as shown in the embodiment of FIG. 7, the inner shaft 1004 may have a single spike tip nozzle 84, an inner shaft conduit 88, and an inner shaft fluid source connection point 90. This configuration can provide one directed stream of fluid. In an alternative embodiment, not shown, the inner shaft 1004 may have a multi-nozzle spike tip mounted on a rotational bearing. In this configuration, fluid pressure may spin the multi-nozzle spike tip to create several rotating streams of fluid. The nozzles in both embodiments may be connected to a fluid source by an inner shaft conduit 88 running through the inner shaft handle to the inner shaft fluid source connection point 90. A fire hose may then be connected to the inner shaft fluid source connection point 90 using a thread coupling, commonly-known as a Stortz coupling, or similar connection method. In accord with embodiments of the present invention, other adapters may also be used to reduce and connect standard fire hoses.

OPERATION

As discussed herein, the multi-purpose firefighting tool 1000 may be used as either a single unit or as separate components. To reduce equipment-related time delays, the embodiments of the present invention may function with or without removing the inner shaft 1004. For example, inner shaft 1004 removal may not be needed for firefighters to chop through walls with the adz head 36 or to search for victims with the light 32. If the inner shaft 1004 is configured with a spike tip 82 and pry fork 62, the tool can also be used to immediately pry doors or pull down ceilings.

The multi-purpose firefighting tool 1000 may be used to quickly pull down ceilings to inspect for hidden fire. For instance, the spike tip 82 can be punched through a ceiling to create a hole large enough for the adz head 36. Users can then repeatedly position the adz head 36 over adjacent, undamaged portions of ceiling and apply downward force by pulling on the outer shaft handle 12. With each repetition, a portion of ceiling may be removed and the space above exposed for inspection.

A user may then use the light 30 to check the crawl space above for charred wood or other signs of fire. Users may extend the light 30 attached to the outer shaft 1002 through the ceiling hole to immediately light the area. Moreover, it may be possible to add a mirror to embodiments of the present invention so that firefighters can visually inspect a variety of non-visible angles without having to climb up into the hole. The light 30 could also be used to inspect other types of hard-to-reach areas or to search for victims in a burning building, Users can hold the outer shaft 1002 near the adz head 36 and sweep the light 30 along the floor. A strong light used close to the floor may significantly increase visibility. A strobe light may also be used so that distressed firefighters can visually signal for help. The strobe light could also be integrated into the light-emitting diode ring 34, attached to the adz head 36, or may be secured to an entirely different location.

To perform certain tasks, firefighters may need to temporarily remove a component from our multiple-purpose firefighting tool 1000. This may be necessary when firefighters want to, for instance, use the adz head 36 to hammer the inner shaft 1004. Firefighters may use the flat adz head back 42 to hammer open a padlock with the spike tip 82 or wedge the pry fork 62 into the crack of a car door. To remove the inner shaft 1004, firefighters may need to disengage the friction lock 24 by flipping back the friction lever 25.

In some cases the spike tip 82 may need to retract completely into the outer shaft 1002. In order to use the adz head 36 as a lever, nothing can protrude from the shaft bays 20U, 20L. Consequently, the multi-purpose firefighting tool 1000 may be designed so that the spike tip 82 can be either extended or retracted. If firefighters want to use the adz head 36 as a lever, but have the spike tip 82 in the extended position, they can disengage the friction lock 24, partially remove the inner shaft 1004, and reengage the friction lock 24 so that the spike tip 82 is retracted within the outer shaft 1002. The reverse procedure may be used to then again extend the spike tip 82.

An embodiment of the inner shaft 1004 has integrated nozzles that can flow fluid into hard-to-reach areas when attached to a pressurized fluid supply. Firefighters may use the spike tip nozzle 84 as a puncture nozzle to extinguish automotive engine fires. Firefighters may also use the flat adz head back 42 to first hammer the spike tip 82 and spike tip nozzle 84 into a car hood. Then, after attaching a fluid source to the inner shaft fluid source connection point 90, fluid can flow through the inner shaft 1004 to extinguish the underlying engine fire. An alternate embodiment with a spinning multi-nozzle spike tip can be used as a commonly-known cellar nozzle to fight basement fires. Rather than sending firefighters down the stairs using a traditional hose, the spike tip 82 could be hammered through the floor above and connected to a pressurized fluid supply. The multi-nozzle spike tip would rotate and direct fluid in many different directions, eventually extinguishing the basement fire.

The examples described herein are merely illustrative, as numerous other embodiments may be implemented without departing from the spirit and scope of the exemplary embodiments of the present invention. Moreover, while certain features of the invention may be shown on only certain embodiments or configurations, these features may be exchanged, added, and removed from and between the various embodiments or configurations while remaining within the scope of the invention. Likewise, methods described and disclosed may also be performed in various sequences, with some or all of the disclosed steps being performed in a different order than described while still remaining within the spirit and scope of the present invention.

What is claimed is:

1. A multi-purpose tool, comprising:

an inner shaft having a first end and a second end;

a first tool at the first end of the inner shaft;

a second tool at the second end of the inner shaft;

an outer shaft having a first open end defining a distal end and a second open end, the first end of the outer shaft having a third tool, and the outer shaft including a central passageway extending between the first end and the second end and through said third tool; and a housing positioned at the second end of the outer shaft, the housing including a recess configured to slidably receive the inner shaft, wherein the housing includes a locking mechanism adapted to secure the inner shaft to the outer shaft;

wherein the inner shaft is removably secured to the outer shaft and slidably received within said central passageway of the outer shaft; and wherein the first tool on the inner shaft extends out from said distal end of the outer shaft when the inner shaft is completely received within said central passageway.

2. The multi-purpose tool of claim 1 wherein the third tool is an adz head.

3. The multi-purpose tool of claim 2 wherein a top of the adz head includes at least one removing blade.

4. The multi-purpose tool of claim 1 wherein the locking mechanism is moveable from an open position to a closed position.

5. The multi-purpose tool of claim 1 further comprising a light disposed on the outer shaft or the inner shaft.

6. The multi-purpose tool of claim 1 further comprising at least one gripping surface disposed on the outer shaft.

7. The multi-purpose tool of claim 1 wherein the first tool is a spike tip.

8. The multi-purpose tool of claim 1 wherein the second tool is a pry fork.

9. The multi-purpose tool of claim 1 wherein the third tool is an adz head including a cut-out configured to receive a cylindrical door lock, said cut-out having at least one removing blade extending in a direction perpendicular to an outer shaft handle.

10. The multi-purpose tool of claim 9, wherein the at least one removing blade comprises two removing blades, and the two blades form a channel therebetween.

11. The multi purpose tool of claim 1 wherein the first tool comprises a nozzle and the inner shaft includes a conduit in fluid communication with a fluid source connection point.

12. The multi-purpose tool of claim 1 wherein the locking mechanism includes a cam and a lever, the lever moveable from an open position to a closed position.

13. The multi-purpose tool of claim 1 wherein the second tool is a pry fork, the first tool is a pivotable spike tip and the third tool is an adz head.

14. The multi purpose tool of claim 13 wherein the inner shaft comprises a nozzle and a conduit in fluid communication with a fluid source connection point.

15. The multi-purpose tool of claim 14 wherein the nozzle is mounted on a rotational bearing.

16. The multi-purpose tool of claim 1 wherein the second tool is a locator beacon.

17. The multi-purpose tool of claim 1 wherein the inner shaft comprises two separate shafts.

18. The multi-purpose tool of claim 1 further comprising a light disposed on the inner shaft, wherein the light automatically turns on when the inner shaft is removed from the outer shaft.

* * * * *